US005269692A

United States Patent [19]

Takahashi

[11] Patent Number: 5,269,692

[45] Date of Patent: Dec. 14, 1993

[54] BOARD-TO-BOARD CONNECTOR

[75] Inventor: Tomoyuki Takahashi, Kawasaki, Japan

[73] Assignee: Fujitsu Limited, Kawasaki, Japan

[21] Appl. No.: 955,996

[22] Filed: Oct. 2, 1992

[30] Foreign Application Priority Data

Nov. 15, 1991 [JP] Japan ..... 3-299445

[51] Int. Cl.[5] ..... H01R 9/09

[52] U.S. Cl. ..... 439/74; 439/733; 439/444; 439/701

[58] Field of Search ..... 439/74, 78, 82, 83, 439/444, 607, 608, 610, 869, 701, 733, 751, 752, 873

[56] References Cited

U.S. PATENT DOCUMENTS 3,897,131 7/1975 Stauffer ..... 439/733 X
4,969,844 11/1990 Sako et al. ..... 439/733
5,133,679 7/1992 Fusselman et al. ..... 439/79 X

*Primary Examiner*—Larry I. Schwartz
*Assistant Examiner*—Khiem Nguyen
*Attorney, Agent, or Firm*—Armstrong, Westerman, Hattori, McLeland & Naughton

[57] ABSTRACT

A board-to-board connector comprises a first and a second insulation body and a plurality of terminals, each of the terminals having contacts at both ends and at least two pairs of bulges near the respective ends and, after press-insertion of the terminals into through-holes of the first and second insulation bodies, the first bulge pair being fixed to the through-hole of the first insulation body and the second bulge pair being fixed to the through-hole of the second insulation body resulting in firmly joining the first and second insulation bodies together. The first insulation body can provide a hollow cave on a contacting side with the second insulation body, which makes it possible to fabricate the first insulation body having a larger height necessary for increasing a height of the connector.

8 Claims, 5 Drawing Sheets

BOARD-TO-BOARD CONNECTOR

BACKGROUND OF THE INVENTION

1. Field of the Invention

The present invention relates to a board-to-board connector of a straight type mounted on a printed circuit board (abbreviated briefly as PC board) and interconnecting two PC boards. More particularly, this invention relates to a board-to-board connector which has a height higher than the existing conventional connectors. The height of the connector of the present invention meets a customer's specific requirement, and an ingenious structure enhances a productivity in mass-production thereof.

2. Description of the Related Art

Many types of board-to-board connectors of a straight type have been proposed and used for interconnecting two PC boards. In interconnecting two PC boards, a board-to-board connector having a specific height is required in some cases. In case that, for example, three PC boards, i.e., first, second and third PC boards are stacked in this order and the far separated first and third boards are required to be interconnected by a connector, a height of the connector is required to be much higher than a height of the conventional connector interconnecting two adjacent PC boards.

An example of the prior art board-to-board connector 1 for the above purpose is shown in FIGS. 1(*a*) and 1(*b*). FIG. 1(*a*) shows an exploded perspective view of the connector 1 including a cross section, and FIG. 1(*b*) shows an assembled side view, partly in cross section, thereof. Though the connector shown in FIGS. 1(*a*) and 1(*b*) is a jack-contact-type connector, a plug-contact-type connector also has the similar structure except a contact structure.

The board-to-board connector of FIGS. 1(*a*), 1(*b*) comprises a plurality of terminals 11 arranged in two lines and inserted and fixed in an insulation body which is composed of a first and a second insulation body 12 and 13. Each of the terminals 11 is composed of a jack contact 11*a*, a board contact 11*c*, and a straight portion 11*b*. In FIG. 1(*a*), only two terminals 11 facing each other are taken out from the connector and illustrated. The board contact 11*c* has an outwardly extending bent portion, and a pair of bulges 11*d* are formed extending on both sides of the straight portion 11*b* of each terminal 11. The terminal 11 is press-inserted (inserted applying pressure) into a through-hole 16 of the first insulation body 12 until the bent portion contacts to a bottom surface 12*b* of the first insulation body 12, thereby the bulge pair 11*d* being fixed to an inside wall of the through-hole 16.

When the first and second insulation bodies 12, 13 are fixed together, the jack contact 11*a* and a part of the straight portion 11*b* are inserted into a rectangular through-hole 18 of the second insulation body 13, and the remainder of the straight portion 11*b* stays in a rectangular through-hole 16 of the first insulation body 12. The through-hole 18 in the second insulation body 13 has two different cross sections, one denoted as 18*b* having the same cross section as that of the through-hole 16 of the first insulation body 12 and the other denoted as 18*a* having a larger rectangular cross section for easy insertion of a plug contact of a mated connector.

Since a main body of the connector 1 shown in FIGS. 1(*a*), 1(*b*) is composed of two insulation bodies 12, 13, these bodies should be fixed together by mechanical fixing measures when assembled. Though there are many fixing ways therefor, one example thereof is shown in FIG. 1(*a*). A top surface 12*a* of the first insulation body 12 is provided with a plurality of lock-arms 20 on a periphery of the top surface 12*a*, each protruding vertically thereon and having a rectangular shaped arm. Only two lock-arms 20 are shown in FIG. 1(*a*). On the contrary, a plurality of lock-protuberances 22 are provided on both side walls of the second insulation body 13 in a manner that each lock-protuberance 22 is engaged into the corresponding lock-arm 20 of the first insulation body 12 when two insulation bodies 12, 13 are joined together.

SUMMARY OF THE INVENTION

It is a general object of the invention to provide a board-to-board connector of a straight type having a specific height which meets a customer's requirement.

It is another object of the invention to provide a board-to-board connector, a height thereof being considerably higher than the conventional board-to-board connectors.

It is a further object of the invention to provide a board-to-board connector having a simple structure, suitable for mass production and still having a high reliability.

Foregoing and related objects are accomplished by a connector of the present invention which comprises a first and a second insulation body and a plurality of terminals, each of the terminals having at least two pairs of bulges and having a function of connecting two insulation bodies. When the terminals are press-inserted into through-holes formed in the first and second insulation bodies, the first bulge pair are fixed to the first insulation body and the second bulge pair are inserted deep into the through-holes of the second insulation body and fixed thereto, therefore, the terminals of the invention have a function of firmly fixing the second insulation body to the first insulation body by themselves without an aid of other mechanical fixing measures.

Further, in accordance with the invention, each terminal is firmly fixed using the bulge pairs to the first and second insulation bodies. Therefore, the first insulation body can provide a hollow cave surrounded by a wall at the position corresponding to a long straight portion between two bulge pairs of the terminal. An overall height of the first insulation body can be easily increased and a length of the through-hole in the first insulation body can be made shorter. The short length of the through-holes also makes a length of a core-pin shorter which is used in a molding process for the first insulation body. A height of the connector according to the invention can be easily increased avoiding difficulty in fabricating the tall first insulation body.

Other and further objects and advantage of the invention will become more apparent from the following description, reference being had to the accompanied drawings.

DETAILED DESCRIPTION OF THE PREFERRED EMBODIMENTS

Figure 1B:
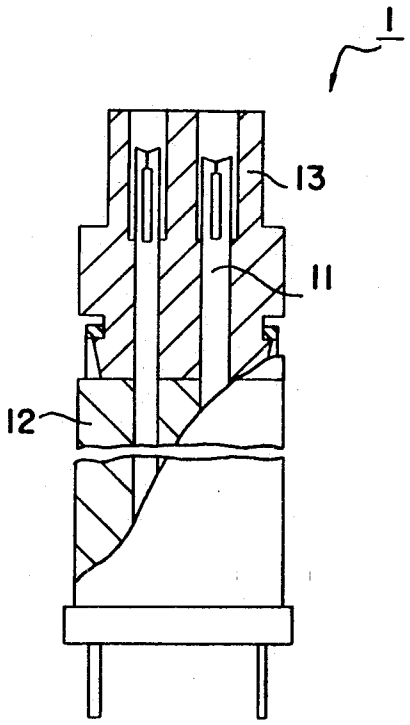
FIG. 1(b) PRIOR ART
FIGS. 1(*a*) and 1(*b*) show schematically a straight-type board-to-board connector of the prior art, in which FIG. 1(*a*) is an exploded partial perspective view thereof, and FIG. 1(*b*) is a side view, partly in cross section, thereof, FIGS. 2(*a*) and 2(*b*) show schematically a straight-type board-to-board connector of the present invention, in which FIG. 2(*a*) is an exploded partial perspective view thereof, and FIG. 2(*b*) is a side view, partly in cross section, thereof.
Figure 1A:
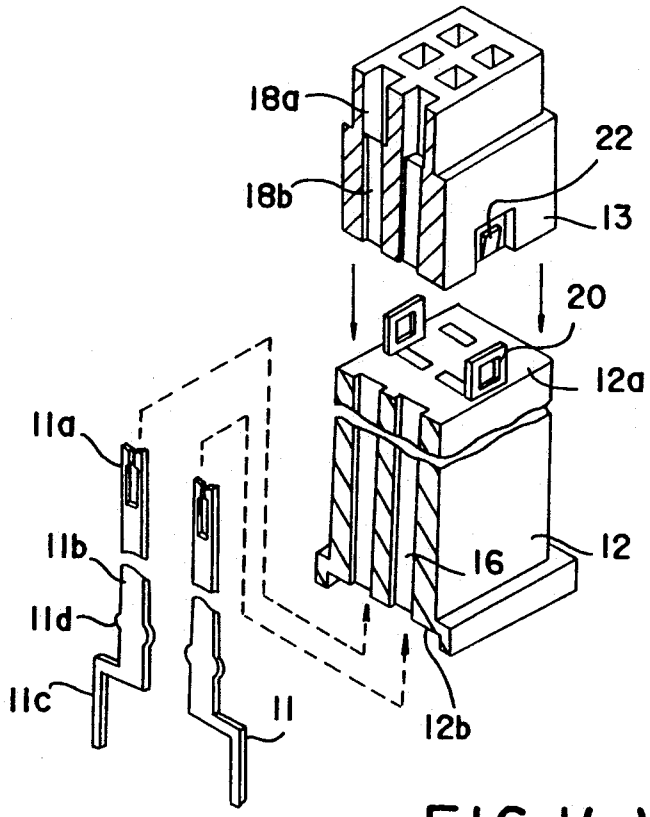
FIG. 1(a) PRIOR ART
Figure 2B:
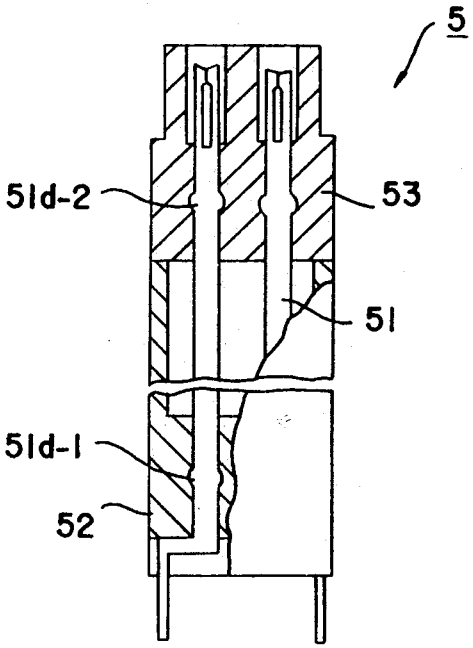
Figure 2A:
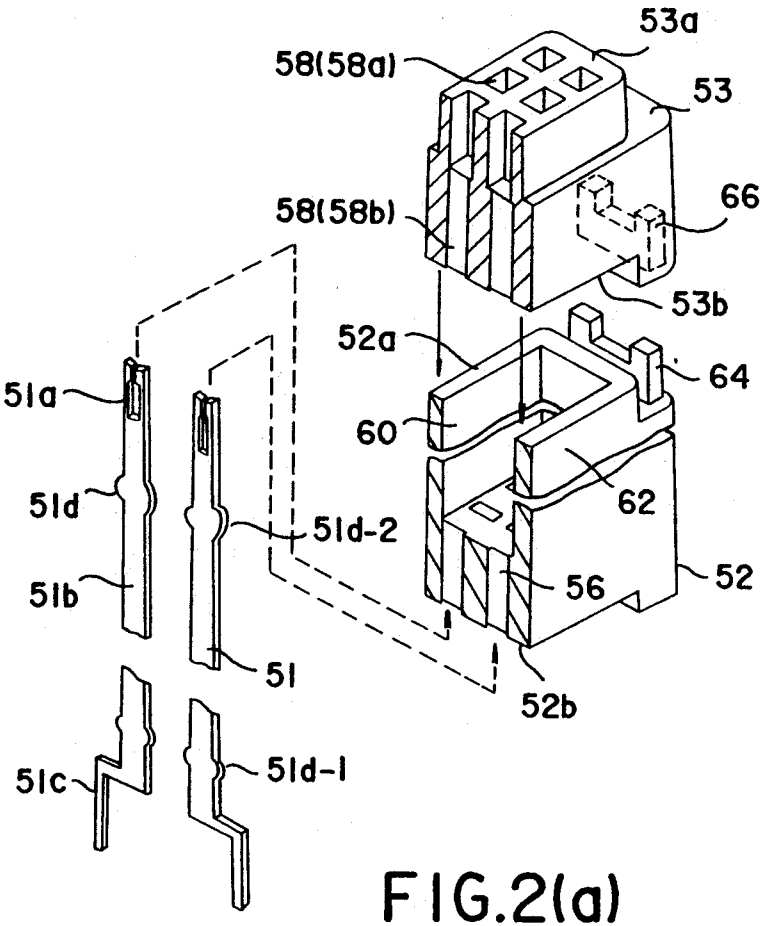

An embodiment of a board-to-board connector 1 in accordance with the present invention is schematically shown in FIGS. 2(*a*) and 2(*b*). FIG. 2(*a*) shows an exploded perspective view of the board-to-board connector 5 including a cross section, and FIG. 2(*b*) shows an assembled side view thereof, partly in cross section. Though the connector shown in FIGS. 2(*a*) and 2(*b*) is a jack-type connector, a connector having other type of contact, for example, a plug-type connector can be formed with the similar structure.

In FIGS. 2(*a*), 2(*b*), the connector 5 comprises a plurality of terminals 51 are arranged in two lines and inserted and fixed in an insulation body which is composed of first and second insulation bodies 52, 53. The first and second insulation bodies 52, 53 form an integral insulation body which is firmly fixed together by an ingenious terminal structure of the present invention.

Each of the terminals 51 is composed of a jack contact 51*a*, a board contact 51*c*, and a straight portion 51*b*. In FIG. 2(*a*), only two terminals 51 facing each other are taken out from the connector and illustrated. The board contact 11*c* has a bent portion to extend the contact outwardly. The straight portion 51*b* of the terminal 51 further includes two pairs of bulges 51*d*, namely, the first bulge pair 51*d*-1 and the second bulge pair 51*d*-2. The first bulge pair 51*d*-1 are formed on the board contact side of the straight portion 51*b*, the bulges outwardly extending in a lateral direction of the terminal, and the second bulge pair 51*d*-2 are formed on the jack contact side of the straight portion 51*b*.

A structure of the first insulation body 52 is shown on the right lower side of FIG. 2(*a*), wherein a plurality of through-holes 56 are formed in a lower portion thereof and arranged in two lines, and a hollow cave 60 is formed in an upper portion thereof surrounded by a side wall 62 and guide posts 64 are formed outside the side wall 62 and on both shoulder portions thereof (only one guide post is shown).

A structure of the second insulation body 53 is shown on the right upper side of FIG. 2(*a*), wherein a plurality of through-holes 58 are formed in an arrangement of two lines, each of the through-hole 58 being composed of an upper through-hole 58*a* and a lower through-hole 58*b*, and guide holes 66 are formed in lower side portions corresponding to the guide posts 64 of the first insulation body 52. The through-holes 58 are formed at the corresponding positions of the through-holes 56 of the first insulation body 52, namely, each of the through-holes 56 is aligned in a line with the respective through-hole 58*b* when two insulation bodies 52, 53 are joined together. The upper through-hole 58*a* has a rectangular cross section for easy insertion of a plug contact of a mated connector.

For assembling the connector 5, the first insulation body 52 and the second insulation body 53 are first stacked together, the guide posts 64 being engaged with the guide holes 66. A bottom surface 53*b* of the second insulation body 53 contacts with a top surface namely, an end surface 52*a* of the side wall 62 of the first insulation body 52, thereby the hollow cave 60 being enclosed within the integral insulation body.

Next, the terminals 51 are inserted from the bottom surface side 52*b* of the first insulation body 52 into the through-holes 56, thereby the jack contact 51*a* and the second bulge pair 51*d*-2 easily penetrating through the through-holes 56. When the insertion of terminals progresses, the jack contact 51*a* and the second bulge pair 51*d*-2 are inserted into the lower through-hole 58*b* of the second insulation body 53, and at the same time, the first bulge pair 51*d*-1 is inserted into the through-hole 56.

In accordance with the present invention, the second bulge pair 51*d*-2 have a smaller lateral width than that of the first bulge pair 51*d*-1, and an inside dimension of the lower through-hole 58*b* is smaller than that of the through-hole 56. Further, the width of the second bulge pair 51*d*-2 is a bit larger than an inside dimension of the through-hole 58*b*, and the width of the first bulge pair is a bit larger than an inside dimension of the through-hole 56. Therefore, the terminals 51 are inserted into both the through-holes applying a pressure (press-insertion). When the bent portion of the terminal contacts to the bottom surface 52*b*, the terminals 51 are press-fitted with both the first and second insulation bodies 52, 53, resulting in joining two insulation bodies firmly.

Figure 3:
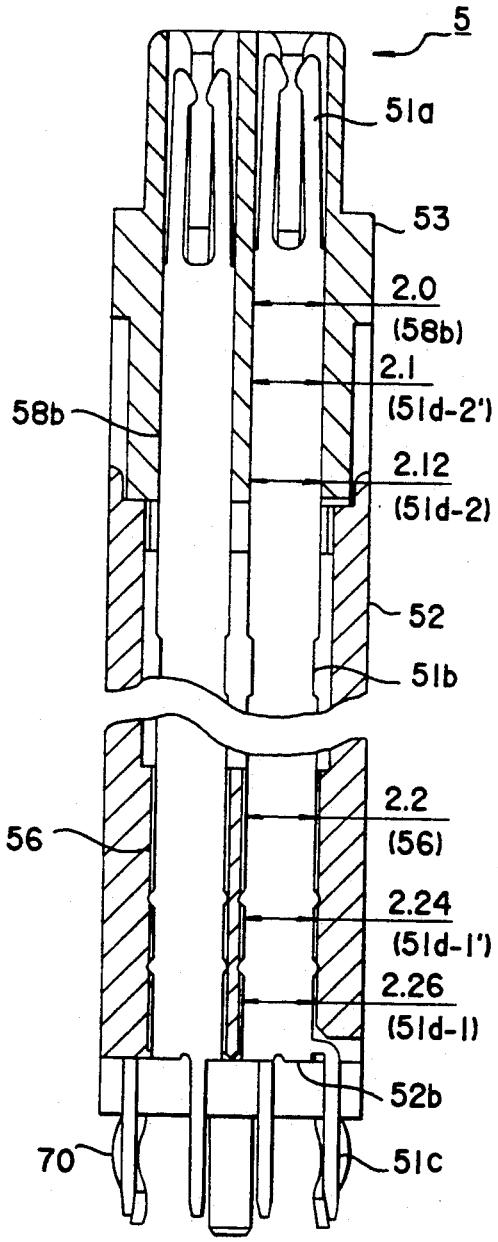
FIG. 3 shows a detailed cross sectional view of a jack-type connector of the present invention.

Relation between the width of the bulge pair and the inside dimension of the through-hole is described in more detail using FIG. 3. FIG. 3 is a cross sectional side view of an embodied connector having the similar construction as FIGS. 2(*a*), 2(*b*). However, the first bulge pair 51*d*-1 and the second bulge pair 51*d*-2 are composed of two bulge pairs respectively, namely, 51*d*-1, 51*d*-1′ and 51*d*-2, 51*d*-2′ in FIG. 3. Widths of these four bulge pairs are shown in FIG. 3 such as 2.26, 2.24, 2.12, and 2.1 mm respectively. The inside dimensions of the through-holes 56 and 58*b* of the first and second insulation bodies 52 and 53 are 2.2 and 2.0 mm respectively. Therefore, the second bulge pairs 51*d*-2, 51*d*-2′ can easily penetrate through the through-hole 56 of the first insulation body 52 but they are firmly fixed to the inside wall of the through-hole 58*b*. The first bulge pairs 51*d*-1, 51*d*-1′ are also fixed to the inside wall of the through-hole 56.

Figure 4:
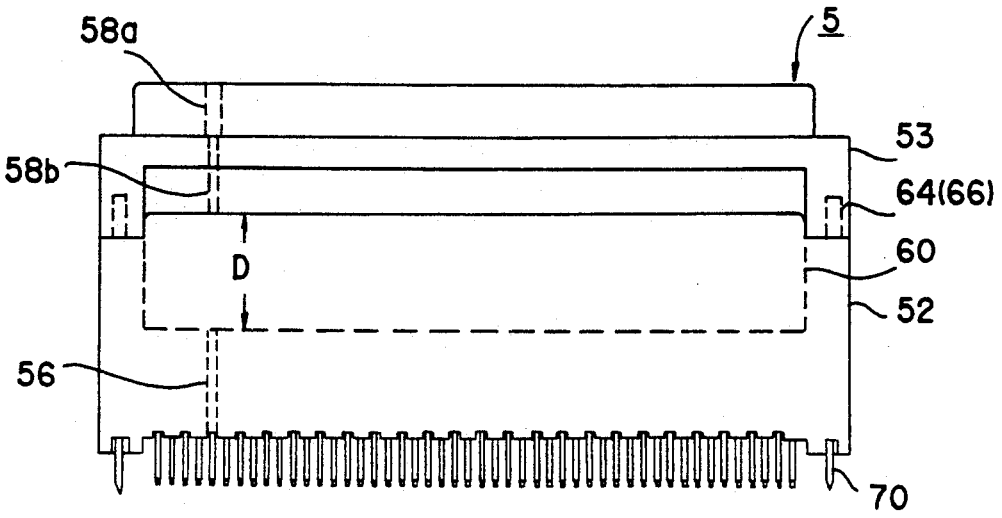
FIG. 4 shows a front elevation view of the completed connector of FIG. 3.

In FIG. 3, two side-by-side adjacent board contacts 51*c* on the bottom surface 52*b* are arranged zigzag in the major width direction of the connector for easy connection with a PC board. FIG. 4 shows a front elevation view of the connector of FIG. 3. Dashed lines are added in FIG. 4 for easy understanding of the structure, in which the same reference numerals designate the similar parts of FIGS. 2(*a*) and 3. By increasing a depth D of the hollow cave 60 and a length of the straight portion 51*b* of the terminals, an overall height of the connector can be increased easily.

Figure 5:
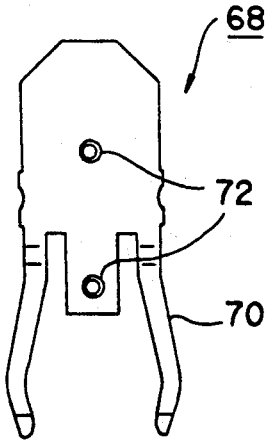
FIG. 5 shows a board lock used for the connector of FIGS. 3 and 4, which is used for firmly fixing the connector with a PC board.

Further, the connector of FIGS. 3 and 4 provides a board lock 68 of spring material which is fixed with the insulation body 52 at both lower side portions thereof. As shown in FIG. 5, the board lock 68 has two leg portions 70 and two protrusions 72. When the board lock 68 is inserted in the first insulation body 52, the board lock is fixed with it by the protrusions 72. The legs 70 have a function of fixing the connector with the PC board.

Figure 6:
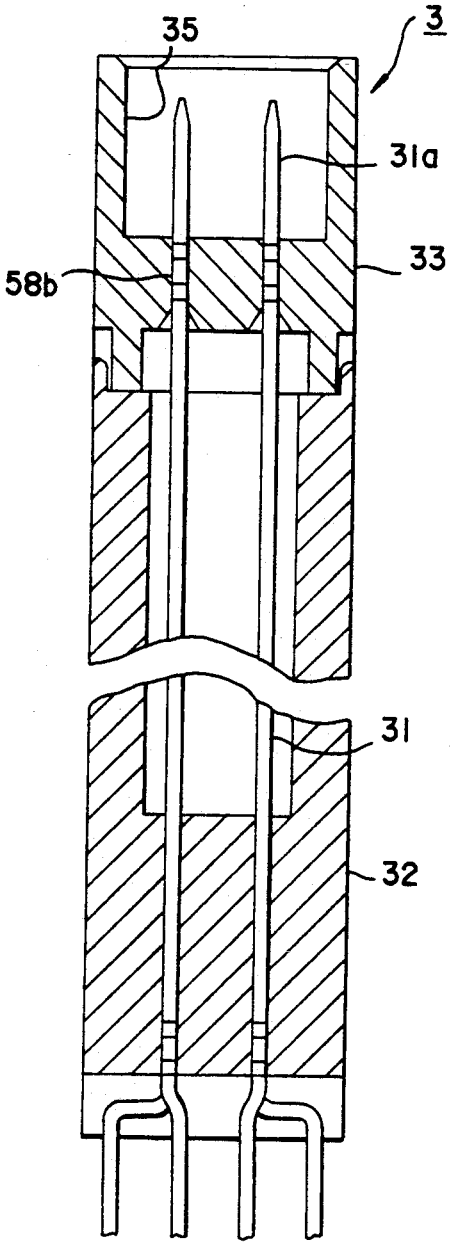
FIG. 6 shows a detailed cross sectional view of a plug-type connector as an another aspect of the present invention.

FIG. 6 is a cross sectional side view of another embodiment of the present invention applied for a plug-type connector 3. A plurality of terminals 31 are arranged in the similar way as the jack-type connector 5 previously described. Though a plug contact 31*a* shown in FIG. 6 looks like a rod at a glance, it has a predetermined width in the direction vertical to a plane of the drawing. Bulge pairs are also formed in the vertical direction to the figure, therefore, they are not shown. Other structures such as a first insulation body 32, a second insulation body 33 and plurality of bulge pairs are substantially the same as those of the jack-type connector 5 shown in FIG. 3. Around the plug contacts 31*a*, a hollow cave 35 is formed in the second insulation body 33, in which there is no partition separating the plug contacts from each other. Therefore, the through-holes 58*b* of the second insulation body 33 end at the bottom of the hollow cave 35.

Figure 7:
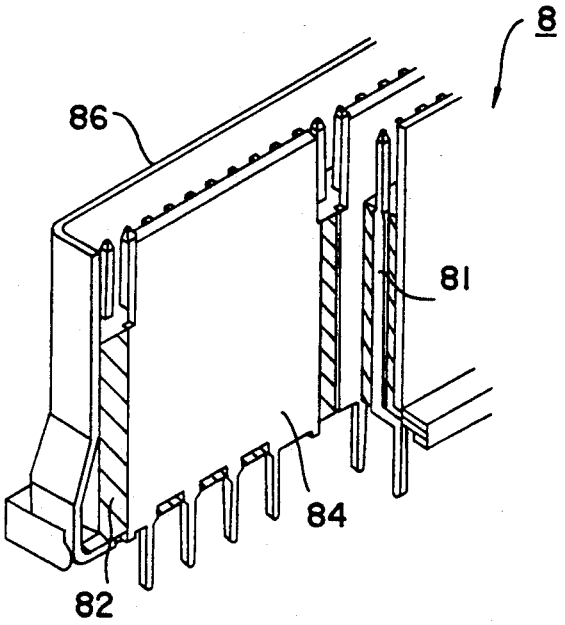
FIG. 7 illustrates a perspective view, partly broken away, of a micro-strip-line type connector as a still another aspect of the present invention.

The present invention can be applied further for a structure of another type connector. In recent years, connectors having characteristics of high-speed signal processing and low cross-talk between signal lines have been required. A connector having a micro-strip-line structure can meet these requirements. FIG. 7 illustrates a schematic perspective view, partly broken away, of a plug-type strip-line connector 8 of the present invention. Each terminal 81 has substantially the similar structure as that shown in FIG. 6, however, bulge pairs are not shown in FIG. 7. Two insulation bodies are joined together and shown as an integrated insulation body 82 therein.

Specific features of the micro-strip-line connector 8 different from the previous jack-type connector 5 and plug-type connector 3 exist in that a ground contact 84 of metal is inserted between two lines of terminals 81 and, further a ground shell 86 of metal is added covering a substantial portion of main connector comprising the integral insulation body 82, terminals 81 and the ground contact 84. As the result, each signal line formed by the respective each terminal 81 is sandwiched between two grounded electrodes of ground contact 84 and ground shell 86, resulting in achieving the above features.

Apart from the above micro-strip-line connector, a ground shell can be effectively used for the conventional jack-type and plug-type board-to-board connectors previously described. The ground shell has functions of shielding electromagnetic interference and, in some cases, enhancing mechanical strength of the connector.

The present invention may be embodied in other specific forms. The presently disclosed embodiments are, therefore, to be considered in all respects as illustrative and not restrictive, the scope of the invention being indicated by the appended claims, rather than the foregoing description, and all changes which come within the meaning and range of equivalence of the claims are, therefore, to be embraced therein.

What is claimed is:

1. A board-to-board connector of a straight type for interconnecting two printed circuit boards, comprising:

a first insulation body and a second insulation body, each having a top surface and a bottom surface vertical to a plug-in direction of the connector, and the second insulation body being disposed on the top surface of the first insulation body forming an integral insulation body, wherein the first insulation body has a plurality of first through-holes formed vertically to the top and bottom surfaces thereof, the first through-holes being formed at regular intervals and aligned in a major width direction of the connector, each of the first through-holes having a predetermined first inside dimension, and wherein the second insulation body has a plurality of second through-holes formed vertically to the top and bottom surfaces thereof, the second through-holes being formed at regular intervals and aligned in a major width direction of the connector, each of the second through-holes having a predetermined second inside dimension which is smaller than the first inside dimension; and a plurality of terminals, each terminal including contacts at both end portions and a straight portion between the contacts, the straight portion including a first and a second pair of bulges extending laterally on both sides of the straight portion, a width of the second bulge pair being smaller than the first inside dimension and larger than the second inside dimension, a width of the first bulge pair being larger than the first inside dimension, each terminal being press-inserted from the bottom surface side of the first insulation body into the first through-hole and second through-hole, to thereby fix the first bulge pair to the first through-hole and fix the second bulge pair to the second through-hole resulting in a subsequent fixing of the second insulation body to the first insulation body.

2. A board-to-board connector as recited in claim 1, wherein the top surface side of the first insulation body, along with a side wall, forms a hollow cave.

3. A board-to-board connector as recited in claim 1, wherein the top surface of the first insulation body includes a guide post, and a bottom side portion of the second insulation body includes a guide hole, wherein the guide post is engaged in the guide hole when the first and second insulation bodies are joined together.

4. A board-to-board connector as recited in claim 1, wherein at least one of the first bulge pair and the second bulge pair comprises a plurality of bulge pairs.

5. A board-to-board connector as recited in claim 1, wherein the terminal has a jack contact at one end and a board contact at the other end thereof, and the jack contact retracts from the top surface of the second insulation body in the second through-hole and a hole size thereof surrounding the jack contact is larger than that of the remaining second through-hole for easy insertion of a plug contact of a mated connector.

6. A board-to-board connector as recited in claim 1, wherein the terminal has a plug contact at one end and a board contact at the other end thereof, and a hollow cave is formed on the top surface side of the second insulation body, thereby the plug protruding in the hollow cave.

7. A board-to-board connector as recited in claim 1, wherein the terminals are arranged in two lines and the connector further comprises a ground contact and a ground shell, the ground contact of metal being inserted between two lines of the terminals and the ground shell of metal covering substantial portion of the first and second insulation bodies, thereby each terminal being sandwiched between two metal plates forming a strip-line structure.

8. A board-to-board connector as recited in claim 1, wherein the connector further comprises a metal shell which covers a substantial portion of side walls of the first and second insulation bodies.

* * * * *